United States Patent [19]

Blackman

[11] Patent Number: 4,617,778

[45] Date of Patent: Oct. 21, 1986

[54] APPARATUS TO FACILITATE HAND PACKING OF CONTAINERS

[75] Inventor: Kent G. Blackman, Sycamore, Ill.

[73] Assignee: The Suter Company, Inc., Sycamore, Ill.

[21] Appl. No.: 810,773

[22] Filed: Dec. 19, 1985

[51] Int. Cl.[4] ..... B65B 67/02

[52] U.S. Cl. ..... 53/391; 53/69; 53/252; 53/390; 53/502

[58] Field of Search ..... 53/391, 390, 247, 252, 53/251, 250, 249, 502, 505, 67, 64, 69; 414/126

[56] References Cited

U.S. PATENT DOCUMENTS

| | | | |
|---|---|---|---|
| 1,441,414 | 1/1923 | Gearhart | 53/390 |
| 1,722,048 | 7/1929 | Hill | 414/126 X |
| 2,322,169 | 6/1943 | Smith | 53/390 X |
| 2,664,833 | 1/1954 | Armstrong et al. | 53/514 |
| 2,742,749 | 4/1956 | McGuire | 53/390 X |
| 2,941,341 | 6/1960 | Clinton | 53/514 |
| 2,969,633 | 1/1961 | Archer | 53/391 |
| 3,494,097 | 2/1970 | Bott et al. | 53/390 X |
| 4,439,101 | 3/1984 | Orlowski et al. | 414/126 |

*Primary Examiner*—James F. Coan

*Attorney, Agent, or Firm*—Robert J. Black

[57] ABSTRACT

Packaging apparatus for facilitating the rapid hand packing of fragile ingredients such as used in salads. Mechanisms are provided to transport empty containers to a filling station, introducing the ingredients by a hand raking procedure into the container and then further moving the containers to a weighing station and finally passing then for sealing and packaging.

15 Claims, 7 Drawing Figures

APPARATUS TO FACILITATE HAND PACKING OF CONTAINERS

BACKGROUND OF THE INVENTION

1. Field of the Invention

The present invention relates to food packaging and more particularly to apparatus that facilitates the hand packing of containers with products having fragile ingredients not usually adaptable to machine packing techniques.

2. Background Art

The automated packaging of food products is well known with special equipment being designed to facilitate the handling of the containers as taught by U.S. Pat. Nos. 1,722,048 and 4,439,101. The actual packing of the food products is taught by numerous patents, including U.S. Pat. Nos. 1,441,414; 2,664,833; 2,969,633 and 2,941,341. None of this latter group of patents, however, adapts itself to the handling of food products such as are included in specialty and refrigerated salad mixes. Most of the state of the art machinery utilizes severe handling procedures that tend to break up, separate or whip together those fragile ingredients usually used in such product mixes, thus eliminating the home made appearance and the flavor and customer acceptance most desirable in such products. Because of the fragile nature and consistency of such products, in that they do not flow by gravity, the products cannot be pumped, extruded, pressed or augered during a container filler operation. Most prior art equipment involves much rough handling of the product during the packaging operation, utilizing techniques that agitate, abuse or tear apart the ingredients so much that the desired integrity of the product is destroyed. None of the present available filling equipment marketed will satisfactorily perform the necessary tasks of properly handling such products. Hand packing of containers with ingredient mixes, such as that envisioned by the present invention, is highly satisfactory. However, the disadvantages attendant with normal hand packing procedures are obvious. Such lack of speed of handling and lack of uniformity in the handling procedure has limited hand packing in the usual sense to very small and limited operations. Other disadvantages of hand packing include the difficulty of keeping the outside of the container clean to maintain acceptable cleanliness to the sterility of the operation. Another problem is the maintenance of nearly exact weight in the container so that check weighing and any correcting operation can be held to a minimum. Conventional hand packing presents substantial problems in these given areas.

SUMMARY OF THE INVENTION

The present invention consists of apparatus to facilitate the hand packing of containers by providing an in-line system of container filling in which the containers would be stopped in position and forced up against the underside of a plate with an opening only slightly smaller in diameter than the container to be filled. The product is then scraped by hand over the openings and into the containers located below. A relatively thin plate would ensure the scraper would fill the container almost exactly full when the product was scraped flush over the holes. Such a system would also keep the outside of the container completely clean since it is clamped tightly against the underside of the opening in the filling plate. in the present system an automatic shuttle and clamp system is utilized to simultaneously remove filled containers and bring in empty ones. This is accomplished through the automatic and sequential energizing of air cylinders, to go through a release, shuttle advance, shuttle return, and clamp cycle. This cycle is controlled by a filling operator who depresses a foot pedal or similar apparatus after the number of containers that are in front of him have been scraped and filled. The air cylinders complete the transfer cycle in a very short time so the operator may again scrape and fill another group of empty containers.

Included in the present apparatus is an automatic dispensing system to feed a constant supply of empty containers onto an incoming moving conveyor belt. The containers which are normally utilized are supplied in cartons of nested vertical stacks in most instances. This dispensing station of the apparatus accepts vertically nested stacks of containers positioned above the incoming conveyor. Located between the vertical stack of containers and the moving conveyor is a sensing trigger that physically detects the presence of a container on the constantly running in-feed conveyor. If the sensing trigger detects a vacancy on the conveyor, it energizes a reciprocating air cylinder to drive cam bars alternately opening and closing two pairs of jaws. These jaws are spaced apart approximately the same distance as between individual containers nested in the stacks and as long as a vacancy is detected on the incoming conveyor, this alternate opening and closing of jaws on the vertical stack of nested containers alternately releases the bottommost container and clamps the next to the bottom container. Conversely, when the sensing trigger detects a stationary container on the moving in-feed conveyor indicating a full conveyor situation, the air cylinder will be stopped, causing the releasing and clamping action on the remaining stack to be terminated and to hold the bottom container in position ready for the next dispensing cycle.

The apparatus of the present system may be arranged so that one operator or a plurality of operators may be employed in the operation of the apparatus and the filling of containers included therein. If multiple operators are employed, each operator can function on a side-by-side basis by controlling his own shuttle clamp system independently from the other. The machine top plate is designed large enough then to cover the number of operator stations employed so that all operators can work from the same batch of freshly blended product. Since the empty containers and filled containers travel on conveyors common to all operator stations, it is necessary to provide a timed delay between the operation of operator foot pedals. This ensures that there is always a supply of empty containers on the incoming conveyor at each fill station and that there is never any interference of filled containers on the discharge conveyor. Both input and output conveyors, of course, operate at a speed sufficient to move the containers downstream either into or away from the operator fill positions within the timed delay period.

DESCRIPTION OF THE PREFERRED EMBODIMENT

Figures 1, 1A:
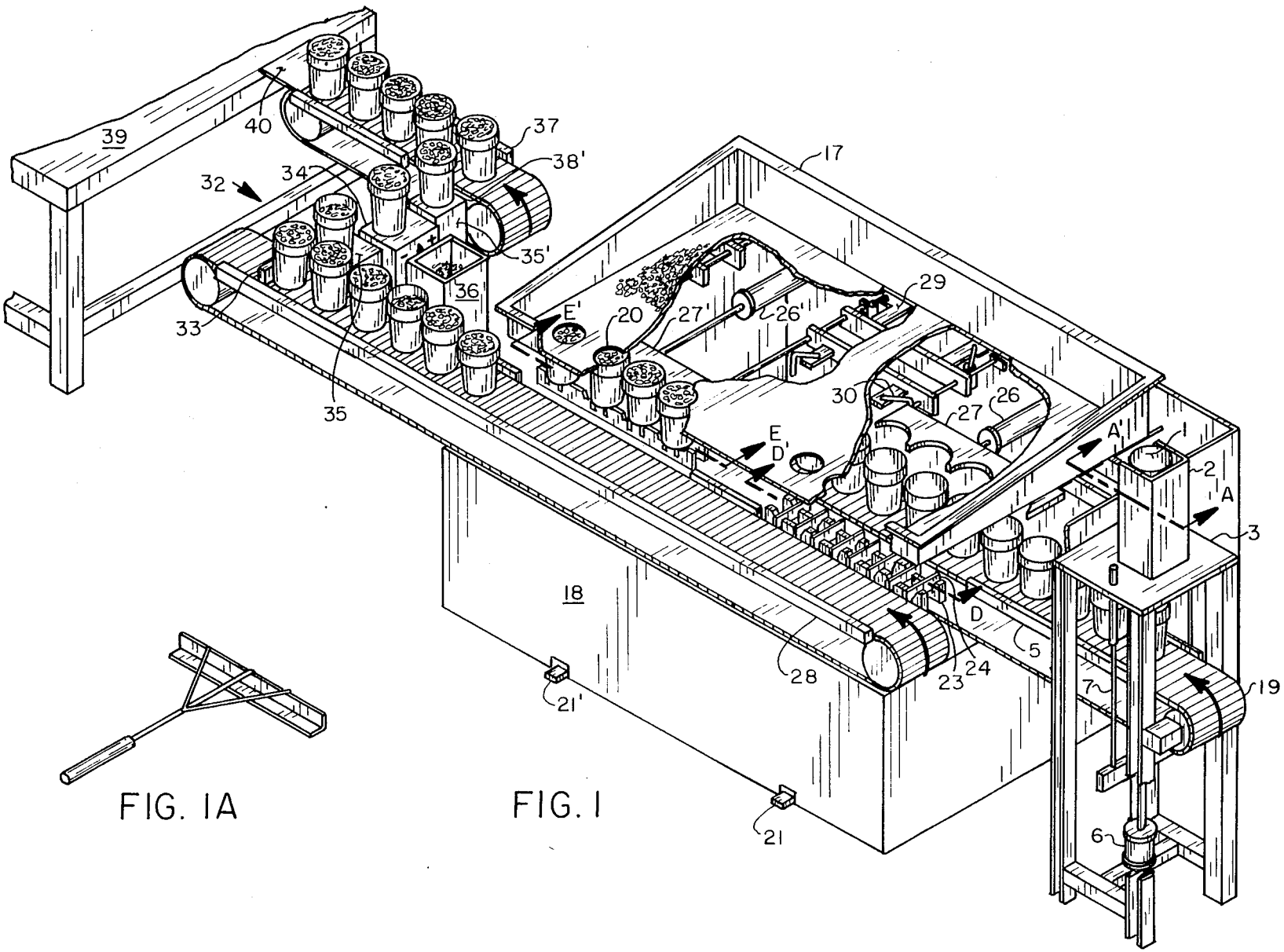
FIG. 1 is a perspective view of apparatus embodying the features of the present invention which utilizes mechanism for assisting in the hand filling of containers with fragile product mixes as described in the present invention.
FIG. 1A is a perspective view of a scraper for use in the hand filling of containers as described in the present invention.
Figure 5:
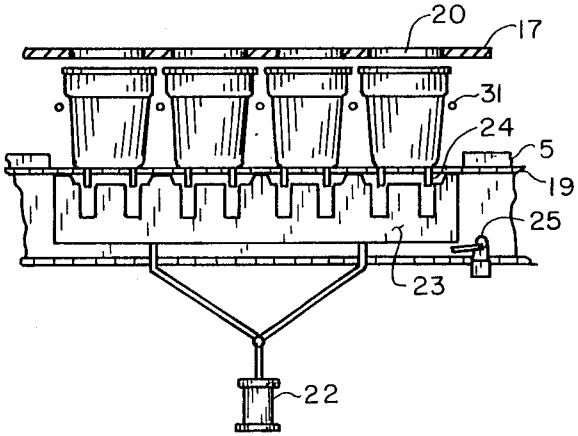
FIG. 5 is a plan view of a portion of the apparatus of the present invention showing the mechanism for supporting the containers between the input and discharge conveyor belts and in location beneath the openings in the top plate of the present invention taken along the section lines D—D of FIG. 1.
Figure 6:
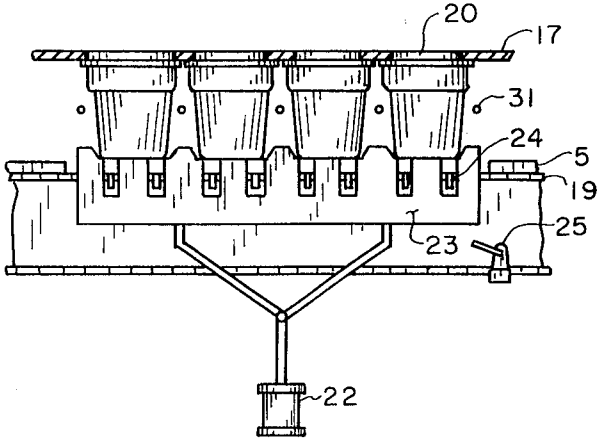
FIG. 6 is a view similar to that shown in FIG. 5 showing the clamping mechanism in its raised position holding the containers in the uppermost or filling position clamped tightly against the bottom of the filler plate taken along the section lines E—E of FIG. 1.
Figure 3:
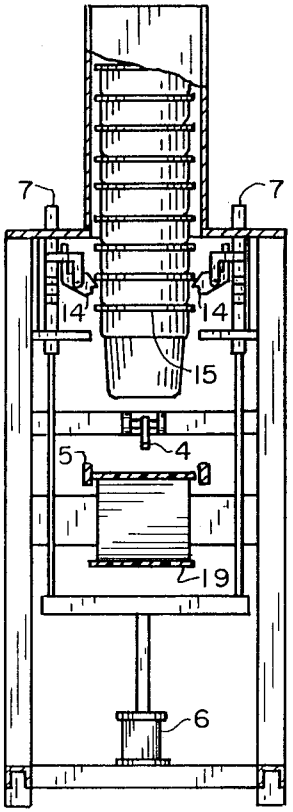
FIG. 3 is an end plan view of the container dispensing mechanism of the present invention taken along the section lines B—B of FIG. 2.
Figure 4:
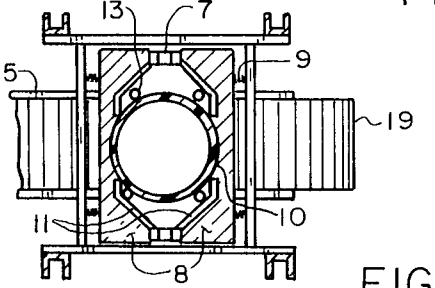
FIG. 4 is a cross-section of the container dispensing unit of the present invention taken through the lines C—C of FIG. 2.

Referring first to FIG. 1, the apparatus in accordance with the present invention is shown as adapted for use by two operators who will stand side by side at positions in front of the machinery shown in FIG. 1. The cup dispensing mechanism located at the one end of the apparatus is as shown in FIG. 1 and also in FIGS. 2, 3 and 4. The cup dispensing apparatus 3 shows a plurality of containers 1 housed or retained within a tubelike magazine 2 with the container dispensing mechanism supporting the containers in location above the in-feed conveyor 5 with the need for a new container detected by sensor 4 which moves in an upward position to detect the absence of a container on conveyor 5 and is utilized to actuate air dispenser cylinder 6 which operates the mechanism of the dispenser station which includes a pair of upper opposed jaws 8 and and a pair of lower opposed jaws 11 with springs 9 acting to restore the jaws to their normal or closed position. The action of the jaws is controlled by two cam bars 7 to which are fastened the ejector clips 14 which engage the lip portion 15 of the lower container as is shown in FIG. 3. Containers dispensed from the container dispensing mechanism are deposited on the in-feed or inward conveyor 5 which consists of an endless belt of low friction flights 19 driven from a constant speed power source (not shown). As can be seen in FIG. 1, the empty containers on the in-feed conveyor 5 are conveyed to positive stop 16 (not shown, but located at the far end of conveyor 5) loading conveyor 5 with empty containers through a plurality of operator fill stations. At each operator fill station there is located a shuttle bar 27 and an associated shuttle bar air cylinder 26, the operation of which is initiated by trigger 25 and returned with air control valve 29. It may be seen by reference to FIG. 1, the scalloped leading edge of the shuttle bar 27 is designed in this instance to engage four containers. Located across the front of the appratus of the present invention is the discharge conveyor 28 similar in construction and operation to the in-feed conveyor 5. Located adjacent to the first operator's fill station is a second operator fill station which includes a shuttle bar 27′, shuttle bar air cylinder 26′ and associated air controls similar to the first operator fill position and the mechanism thereof. The air source for cylinders 6, 22, 26, and associated air controls has not been described since it is conventional in nature and does not form a part of the present invention. The filling stations of the present invention and the appratus associated therewith are mounted on or within a base 18 with a foot pedal 21 or 21′ associated with each position located near the front thereof with easy access by the foot of the operator. Located between the in-feed conveyor 5 and the discharge conveyor 28 are clamping units like that shown in FIG. 5, which is a section taken along the lines D—D of FIG. 1. As can be seen by reference to FIG. 5, the containers are supported on deadplate transfer rails 24 and between guides 31 in a position below the top plate 17 and positioned when the shuttle bar is in its forward position directly below the openings 20 in top plate 17. A clamping saddle 23 is located beneath the containers and is operated in turn by air cylinder 22 which is energized by air control valve 30 located at the rearward end of the stroke of shuttle bar 27. As seen in FIG. 6, after the air cylinder has operated the clamping saddle, the clamping saddle 23 moves upward to raise the containers directly into clamped contact with the lower surface of top plate 17.

It should be understood that top plate 17 is box-like in construction and covers most of the upper portion of both filler stations shown in FIG. 1 and contains in the present embodiment eight openings (four openings for each station) and provides sufficient capacity for a substantial portion of mixed ingredients to be introduced into the containers which when the containers are located beneath the openings and held in the upward position are filled by means of moving with a scraper or rake-like device (as shown in FIG. 1A) the product mix into and across the openings by the operator in a manual mode. At the far end of the discharge conveyor 28 beyond one or more operator check-weigh stations like station 32 there is located a positive stop 33 which acts to stop the containers adjacent to the deadplate platform 35 located at the last check-weigh station. At the check-weigh locations an additional amount of product mix is available in container 36 and may be added to or subtracted from the existing filled containers while said containers are resting on digital scale platform 34. After exact weight is obtained, the containers are slidably advanced to the second deadplate platfrom 35′ and then moved on to a packing conveyor 37 similar in construction to both the in-feed conveyor 5 and discharge conveyor 38. At the end of this conveyor another deadend plate 40 is located adjacent to a packing table 39. Openings 38 and 38′ are included in the rails of the discharge conveyor and the packing conveyor to facilitate easy sliding movement of the containers onto or off of the deadplate platforms 35 and 35′. A sufficient number of check-weigh stations 32 are provided along the length of discharge conveyor 28 so that check-weigh operators can keep up with the productions rate of the container filling apparatus.

A more complete and thorough understanding of the present invention may be had by reference to the following description of the mode of operation of the filling operation utilizing the present apparatus.

Referring now to FIG. 1, a stack of empty containers 1 is placed manually in the vertical magazine 2 of dispenser station 3. A sensor device 4 which can be readilly seen by reference to FIGS. 2 and/or 3 located beneath the vertical stack of containers senses the absence or presence, in this case an absence of containers, and automatically activates dispenser air cylinder 6 which operates the associated cam bar mechanism 7 to drop an empty container onto the moving in-feed conveyor belt 5.

Figure 2:
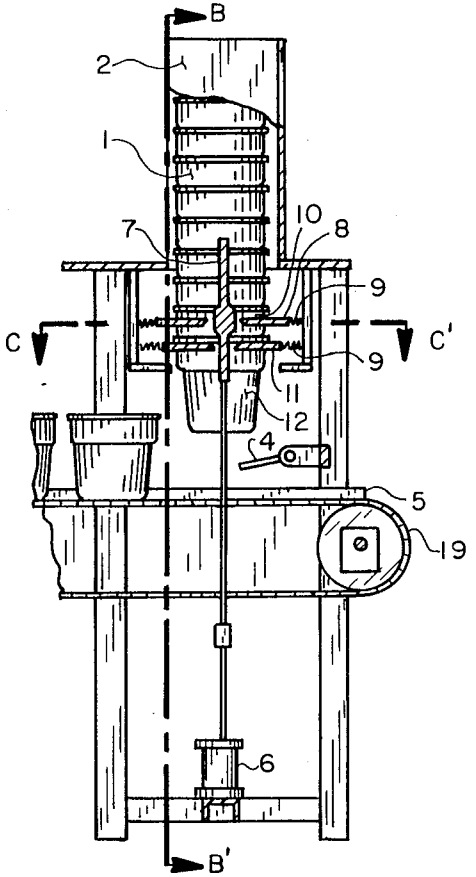
FIG. 2 is a side plan view of the container dispensing portion of the present invention taken along the section lines A—A of FIG. 1.

When the dispenser air cylinder 6 is operated in response to the actuation of sensor 4 and from an air source connected thereto (not shown) the twin cam bars 7 will move downward closing the upper pair of opposed jaws 8 by compression springs 9 onto the second container from the bottom 10 holding the entire stack in place. The continued further downward motion of cam bar 7 allows the upper jaws 8 to hold clamped in place on the stack by spring pressure 9 while simultaneously the cam bars 7 open the lower pair of closed jaws 11 which frees the bottommost container 12 as seen in FIG. 2, allowing it to fall onto the moving in-feed conveyor 5. Also acting simultaneously are the counter-weighted ejector clips 14 carried on the moving cam bar 7 which automatically engage lip 15 of bottom container 12 forcing the start of the downward fall of the bottom container as seen in FIG. 3.

On the upward or return stroke of cam bars 7 the lower pair of opposed jaws 11 will be closed by the compression springs 9. Continuing futher upward movement of cam bars 7 forces open the top pair of opposed jaws 8 allowing the entire nested stack 1 of containers to drop down between guides 13. The closed lower opposed jaws 11 then stop the fall of the entire stack 1 when lip 15 of the new bottom container strikes jaws 11 thereby holding the stack in proper position for the next sequence of operations.

As long as the sensor device 4 detects a vacant container position on the in-feed conveyor 5, the air cylinder 6 will repeat the up and down cycling of cam bars 7 dispensing one empty container onto the conveyor with each cycle. If the sensor detects a full or satisfied position on the in-feed conveyor 5, the air cylinder will automatically stop at the top of the stroke of cam bar 7.

The continuously moving in-feed conveyor 5 moves the empty containers from the dispensing station to a positive adjustable stop 16 completely filling in-feed conveyor 5 just below top plate 17 of the in-line filler machine 18. After the operator fills the containers with product by moving a scraper or rake-like device (FIG. 1A) across openings 20 in the surface of top plate 17, they are shuttled by shuttle bar 27 onto the moving discharge conveyor 28 and the dispenser 3 will automatically refill the in-feed conveyor 5 with additional empty containers. When the empty containers hit positive stop 16, which is adjustable for location, on the in-feed conveyor 5 and below top plate 17 they are held stationary in a contiguous in-line position with the moving low friction conveyor flights 19 sliding under the containers. This stationary position of containers automatically aligns them in line with but behind the holes 20 in top plate 17 of filler machine 18. The holes 20 in top plate 17 are slightly smaller than the open tops of the empty containers and are spaced identically to the contiguous in-line spacing of the empty containers aligned along conveyor 5. After filling the containers at his station, the operator depresses foot pedal 21 starting the air control shuttle and clamp cycle. First the clamp air cylinder 22 releases the clamp saddle 23 to the position as shown in FIG. 5 lowering any previously filled containers onto deadplate transfer rails 24. The clamping cylinder 22 holds at the bottom of its stroke and also energizes with trigger 25 the forward motion of shuttle bar air cylinder 26. The shuttle bar 27 them moves forward from back to front laterally engaging with its scalloped leading edge a given quantity of empty containers (four) held in stationary in-line position on the in-feed conveyor 5 at a 90 degree angle to the shuttle bar motion. Continuing forward movement of the shuttle bar 27 moves the empty containers forward between guides 31 into direct alignment for filling position beneath holes 20 in top plate 17. These empty containers in moving into the fill position also force any previously filled containers forward sliding them off the deadplate transfer rails 24 located between guides 31 and onto the moving discharge conveyor 28. The end of the forward stroke of shuttle bar 27 coincides with the proper filling position for empty containers.

While the shuttle bar 27 is moving forward replacing filled containers with empty ones, the right end of the shuttle bar 27 is in line with the leading edge of the next following empty container on the in-feed conveyor 5. This next following empty container is thus held in stationary position during the full forward stroke of the shuttle bar air cylinder 26.

At the forward end of the shuttle bars travel, an air control valve 29 is engaged and the air cylinder 26 reverses returning shuttle 27 to its rearward or start position. As the shuttle completes its return on the rearward stroke, the next following empty container on conveyor 5 is released by the right end of shuttle bar 27 allowing all the following empty containers to advance in line until stopped by a positive stop 16 or other empty container thus maintaining a contiguous in-line full position on the in-feed conveyor 5.

When the shuttle bar air cylinder 26 reaches its normal rearward or starting position, it triggers an air control valve 30 causing energization of the saddle clamp air cylinder 22 whose location can readily be seen by reference to FIGS. 5 or 6, causing saddle clamp 23 to rise into its normal or clamping position. That is to rise from the unclamped position shown in FIG. 5 to the clamped position shown in FIG. 6. In this position the saddle clamp 23 aligns and holds the given quantity of empty containers tightly clamped against the underside of top plate 17 with the containers held directly below the holes 20 in the fill position. This fill position is maintained during the manual filling operation using scraper tool (FIG. 1A) until the operator again depresses the foot pedal 21. The filled containers which are then transferred onto the moving discharge conveyor 28 by shuttle bar 27 are carried along the conveyor 28 until they reach a positive stop 33 at the last check-weigh station 32. The filled containers are then held stationary and in-line by the positive stop 33 while the low friction flights 19 on the moving conveyor 28 slide underneath the containers. Each check-weigh station consists of a special stand supporting a commercial digital read out over/under scale 34 with the level of the scale platform being at the same level as the discharge conveyor 28 carrying the filled containers. Also at the same level are two deadplate platforms 35 and 35' mounted one on each side of the scale support stand. A bracket mounted on the front side of the scale support stand is at a convenient height to hold a small container 36 of the same product used to fill the containers at the fill stations.

The check-weigh support stand with its deadplate platforms 35 and 35' at eight side is positioned between the discharge conveyor 28 adjacent to deadplate 35 on one side and a packing conveyor 37 of similar construction to that of the discharge conveyor 28, and adjacent to deadplate 35′ on the other side. Located at deadplates 35 and 35′ are openings 38 and 38′ in the side rails of conveyors 28 and 37, respectively, which permit the filled container to be slidably moved by the check-weigh operator from the discharge conveyor 28 through side rail opening 38, across the deadplate 35, and onto the scale weighing platform 34.

At this station the check-weigh operator using a spatula-like tool or a similar device in the small container of product 36 located at the front of the scale platform, either adds to or subtracts from the product in the filled container being weighed on the scale platform 34. When the exact desired weight shows on the digital read out, the operator then slidably moves the filled container across the other deadplate 35′ and through the side rail opening 38′, onto the moving packing conveyor 37. The moving packing conveyor 37 then transports the exact weight filled containers to a packing table 39 holding a quantity of filled containers. This conveyor 37 terminates at deadplate 40 so that the advancing pressure of the following filled containers pushes the first container across the deadplate 40 directly onto the packing table 39. At the packing table, the containers are manually sealed and placed in shipping cartons. The cartons are then closed through a commercial carton sealer and manually skidded for storage in refrigerated warehouses prior to shipment.

As disclosed in the present embodiment the present multiple station in line filler is shown as a two position apparatus with completely separate controls and mechanisms at each position. A interlock/lock out system of air controls is provided so that the discharge conveyor 28 is clear of filled containers in front of each filling station before the foot pedal can be operated to advance the next shuttle cycle.

The actual filling process is accomplished by the operator manually manipulating a hand held scraper or rake-like device as shown in FIG. 1A. After a batch quantity, in the present embodiment this has been determined to be as much as 2000 pounds, is dumped on the top plate 17, the operator employs the scraper or rake-like device to draw a quantity of product across a given number of holes 20. The width of the scraper is sufficient to cover the given quantity of holes at each operator station in one stroke. Excess product is scraped away leaving the containers substantially level full flush with the surface of top plate 17. The operator then activates the foot pedal 21 initiating the next release/-shuttle advance/shuttle return/clamp cycle.

The present apparatus, while developed particularly to handle fragile, chunky, paste-like material, may very well find useful application for other uses. Its utilization of common devices and mechanisms such as cams, air cylinders and air control valves which are readily available and are state-of-the-art devices makes it readily adaptable to many uses. It should be noted, however, that the specific sequence of operations in performing the timing functions to accomplish the dispensing, movement, location and filling actions on product containers constitutes a new and useful combination of ideas. It will also be obvious to those skilled in the art that numerous modifications of the present apparatus can be made without departing from the spirit of the present invention which shall be limited only by the scope of the claims that are appended hereto.

What is claimed is:

1. Apparatus to facilitate the manual filling of a plurality of containers with a product, said apparatus comprising:

a continuously operating in-feed conveyor;

a container dispenser station periodically operated to dispense containers onto said in-feed conveyor;

a plurality of transfer rails positioned adjacent to said in-feed conveyor;

operating means;

at least one shuttle bar operated in response to an initial manual operation of said operating means to move a first plurality of said containers from said in-feed conveyor onto said transfer rails;

a filler plate, including a plurality of openings therein, said plate supporting a quantity of said product;

said openings in said plate being positioned over said transfer railings and over said containers thereon;

at least one clamp saddle initially positioned below said transfer rails and operated in response to said initial manual operation of said operating means to move said plurality of containers on said transfer rails, off of said rails and upward against said filler plate;

whereby said product can be manually introduced from said plate into said plurality of containers and said containers are filled.

2. Apparatus as claimed in claim 1 wherein:

there is further included a continuously operating discharge conveyor positioned adjacent to said transfer rails;

and in response to a subsequent manual initiation of said operating means, said clamp saddle is restored to its initial position and said filled containers are returned to said transfer rails; and said shuttle bar reoperated in response to said subsequent operation of said operating means to move a second plurality of containers from said in-feed conveyor onto said transfer rails, thereby forcing said first plurality of containers from said transfer rails onto said discharge conveyor.

3. Apparatus as claimed in claim 2, wherein:

there is further included a continuously operating packing conveyor;

at least one weighing station positioned between said discharge conveyor and said packing conveyor;

said containers on said discharge conveyor manually moved from said discharge conveyor to said weigh station;

whereby each of said filled containers are weighed and subsequently manually moved from said weighing station to said packing conveyor.

4. Apparatus as claimed in claim 3, wherein:

there is further included a packing station;

and said packing conveyor is operated to move said filled and weighed containers from said weighing station to said packing station where said filled and weighed containers are manually closed and packed.

5. Apparatus as claimed in claim 1, wherein:

said dispenser station comprises a magazine including a plurality of containers vertically stacked therein:

a lower pair of jaws positioned initially adjacent to and holding a container located at the bottom of said stack;

an upper pair of jaws initially positioned adjacent to a container located immediately above said container located at the bottom of said stack;

sensor means positioned adjacent to said in-feed conveyor, operated in response to the lack of presence of a container in contact with said sensor to render an associated actuator means operated;

said actuator operated to cause said lower pair of jaws to release said bottom container onto said in-feed conveyor and further operated to cause said upper pair of jaws to hold said container directly above said bottom container;

and said sensor further operated in response to the presence of a container on said in-feed conveyor to restore said upper and lower jaws to their initial positions.

6. Apparatus as claimed in claim 5, wherein:

said actuator means include at least one shuttle bar connected to an adjacent air cylinder and operated in response to said sensor.

7. Apparatus as claimed in claim 6, wherein:

said upper and lower jaws are normally biased in a closed position against spring means and are alternately opened or closed in response to the operation of said actuator.

8. Apparatus as claimed in claim 1, wherein:

said continuously operating in-feed conveyor includes a plurality of low friction flights and positive stop means, said lower friction flights enabling containers located on said in-feed conveyor to stay in place in response to said conveyors being in contact with said positive stop.

9. Apparatus as claimed in claim 2, wherein:

said discharge conveyor comprises of a plurality of low friction flights and there is further included a positive stop located adjacent to said discharge conveyor, said combination of said low friction flights and said positive stop facilitating the retention of containers on discharge conveyor.

10. Apparatus as claimed in claim 2, wherein:

said transfer rails are positioned between said in-feed conveyor and said discharge conveyor with an upper portion of said rails being directly in line with both of said conveyors facilitating movement from said in-feed conveyor to said discharge conveyor.

11. Apparatus as claimed in claim 1, wherein: said operating means include at least one air cylinder connected to an associated air supply and rendered operated in response to the manual operation of an associated foot pedal.

12. Apparatus as claimed in claim 1, wherein:

said filler plate openings are of the same shape as said containers but slightly smaller in size to ensure the cleanliness of the exterior of said containers when said product is introduced into said containers.

13. Apparatus as claimed in claim 1, wherein:

said operating means further include an air cylinder connected to said clamp saddle operated to move said clamp saddle from its initial position below said transfer rails in an upward direction around said transfer rails and into contact with the bottom of said containers to force said containers in an upward direction and in contact with said filler plate.

14. Apparatus as claimed in claim 3, wherein:

there is further included a container adjacent to said weighing station containing a small quantity of the said product as is located on said filler plate, said product manually added to or removed from said filled containers to ensure said containers weigh an exact and predetermined weight.

15. Apparatus as claimed in claim 3, wherein:

said weighing station includes a digital scale operated in response to the placement of a filled one of said containers on said scale to indicate the absence or presence of more or less than a predetermined amount of said product.

* * * * *